United States Patent [19]

Larws

[11] Patent Number: 4,861,307

[45] Date of Patent: Aug. 29, 1989

[54] WHEEL FOR A MODULAR ASSEMBLY SYSTEM

[75] Inventor: Peter Larws, Usingen, Fed. Rep. of Germany

[73] Assignee: Palimondial S.A., Brasseur, Luxembourg

[21] Appl. No.: 72,674

[22] Filed: Jul. 13, 1987

[30] Foreign Application Priority Data

Jul. 17, 1986 [DE] Fed. Rep. of Germany ..... 3624084

[51] Int. Cl.[4] ..... A63H 17/00; A63H 33/08

[52] U.S. Cl. ..... 446/95; 446/124

[58] Field of Search ..... 446/95, 96, 124, 126, 446/125, 127

[56] References Cited

U.S. PATENT DOCUMENTS 2,088,128 7/1937 Benjamin ..... 446/95

2,709,318 5/1955 Benjamin ..... 446/124

2,722,772 11/1955 Steanes ..... 446/126

3,552,056 1/1971 Meates ..... 446/126

4,376,351 3/1983 Larws ..... 446/124

*Primary Examiner*—Robert A. Hafer

*Assistant Examiner*—Michael Brown

*Attorney, Agent, or Firm*—Nies, Webner, Kurz & Bergert

[57] ABSTRACT

In a wheel for use with a modular assembly system with plug-in-type elements, the dimensioning of all of the elements being based on a basic unit length a, the wheel having a square central axle hole with a cross-section of a×a, rectangular slots witha width a being radially cut into both of the laterial faces of the wheel and arranged in pairs axially opposite to each other, axial openings are provided in the areas of the slots to provide a connection between the axially opposed slots.

6 Claims, 1 Drawing Sheet

WHEEL FOR A MODULAR ASSEMBLY SYSTEM

FIELD OF THE INVENTION

The invention relates to a wheel for use with elements of a plug-in-type modular assembly system, and more particularly to a wheel having circumferentially disposed, radially extending slots for connecting the elements to the wheel, where the dimensioning of the elements of the plug-in-type modular assembly system is based on a basic unit length a.

BACKGROUND OF THE INVENTION

The elements of the modular assembly system are disclosed in U.S. Pat. No. 3,838,535 and comprise, among others, a wheel which is described in U.S. Pat. No. 4,376,351. The wheel has a square central axle bore with a cross-section of a×a and rectangular slots of the width a which are axially opposed in pairs and which are cut radially into both of the lateral faces of the wheel.

With the wheel according to U.S. Pat. No. 4,376,351, the plug-in-type elements of the system can only be plugged onto the wheel by means of these radial slots, i.e. by a non-positive connection. With higher speeds of the wheel the strength of this non-positive radial connection between wheel and plug-in-type element may be overcome by the considerably increasing centrifugal forces so that the connection will give way.

Furthermore, this kind of connection between the wheel and the system element is too specific and restricts the possible combinations, i.e. the usability of the wheel, in a very unsatisfactory way.

OBJECTS AND SUMMARY OF THE INVENTION

It is therefore an object of the present invention to provide a wheel having more universal and stable connection capabilities for plug-in-type elements of a modular assembly system and which will overcome all of the disadvantages of the known prior art.

More specifically it is an object of this invention to provide a wheel of the type having pairs of circumferentially disposed, radially extending slots adapted for connecting thereto such plug-in-type elements, with axially extending openings interconnecting the slots of each pair so that the elements can be plugged in to the wheel axially, i.e. in the direction of the wheel axis.

The wheel construction of the present invention thereby makes possible an immense number of new connection combinations with the aforementioned system elements. In the case of a radial load, centrifugal forces of any high magnitude will be supported due to the positive connection.

DETAILED DESCRIPTION OF THE INVENTION

Figure 1:
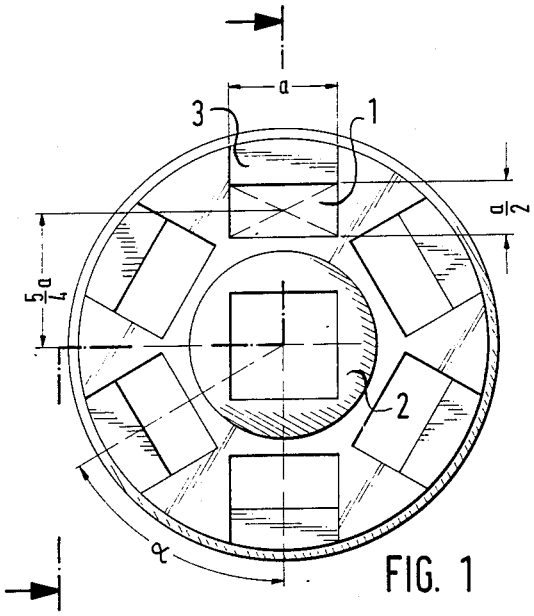
Figure 1A:
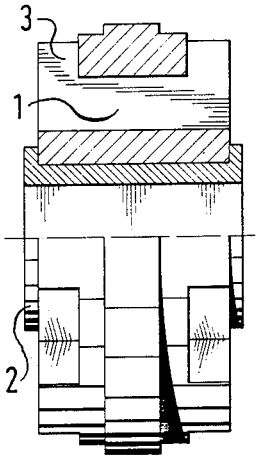
Figure 2:
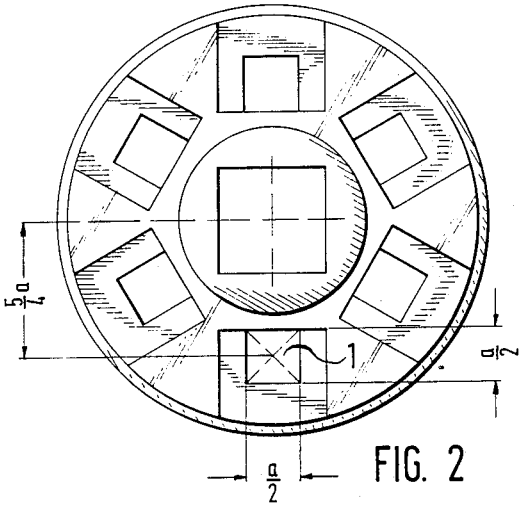

The invention is illustrated by way of examples in FIGS. 1, 1*a* and 2 in the drawing.

FIG. 1 shows a first wheel embodiment 2 according to the invention with six axial openings 1 in the area of each pair of mutually opposed, radially extending slots 3, each axial opening 1 having a cross-section of a×a/2. It can be seen that the openings 1 are arranged at equiangular locations about the wheel circumference such that the angle between the center points of the openings is 180° for two openings 120° for three openings, 90° for four openings, 60° for six openings and 45° for eight openings.

FIG. 1*a* shows the embodiment of FIG. 1 partly in lateral cross-section.

FIG. 2 shows a second wheel embodiment 2' of the present invention with six axial openings 1 each having a cross-section of a/2×a/2.

In each embodiment the distance between the center points of the axial openings and the center of the wheel 1 is 5/4a.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A wheel for use in a modular assembly system including plug-in-type elements, the wheel having a central axle hole with a square cross-section the sides of which have the dimension a and having pairs of circumferentially distributed, radially extending rectangular slots with a width a radially cut into opposing lateral faces of the wheel and arranged axially opposite to each other, said slots each having a flat base and parallel side walls normal to said base, said wheel furthermore comprising axially extending through passages of uniform rectangular cross section from end to end, each interconnecting the slots of one of the pairs, said passages having top, bottom and side walls, at least said bottom wall being a continuation of the base of said one of said pairs of slots and being dimensioned as a function of the dimension a so that the elements can be plugged into the wheel axially.

2. A wheel according to claim 1, wherein the axial openings have a rectangular cross-section of a×a/2.

3. A wheel according to claim 2, wherein the center points of the axial openings have a distance from the center of the wheel axle of 5/4 a.

4. A wheel according to claim 1, wherein the axial openings have a square cross-section of a/2×a/2.

5. A wheel according to claim 4, wherein the center points of the axial openings have a distance from the center of the wheel axle of 5/4 a.

6. A wheel according to claim 1, wherein the openings are arranged at equiangular spacings from each other.

* * * * *